United States Patent [19]

Perl et al.

[11] 4,447,096

[45] May 8, 1984

[54] CABINET ASSEMBLY SYSTEM

[75] Inventors: Ludovic Perl, Chomedey; Bill Szabo, Montreal, both of Canada

[73] Assignee: Herder, N.V., Willemstad, Netherlands Antilles

[21] Appl. No.: 348,978

[22] Filed: Feb. 16, 1982

[51] Int. Cl.[3] ..... A47B 43/00

[52] U.S. Cl. ..... 312/111; 312/263; 403/231

[58] Field of Search ..... 312/111, 257 R, 257 SK, 312/263; 403/231, 205, 255

[56] References Cited

U.S. PATENT DOCUMENTS

| | | | |
|---|---|---|---|
| 3,053,558 | 9/1962 | Challas, Jr. et al. | 312/111 |
| 3,195,968 | 7/1965 | Freeman | 312/263 |
| 3,896,743 | 7/1975 | Pariente | 312/263 |
| 3,964,810 | 6/1976 | Myrphy | 312/111 |
| 4,021,129 | 5/1977 | Sykes | 403/255 |
| 4,036,371 | 7/1977 | Michel | 403/231 |
| 4,045,104 | 8/1977 | Peterson | 312/257 R |
| 4,157,852 | 6/1979 | Zacky | 312/263 |

FOREIGN PATENT DOCUMENTS

| | | | |
|---|---|---|---|
| 2436439 | 2/1976 | Fed. Rep. of Germany | 312/257 R |
| 1199970 | 12/1959 | France | 312/111 |
| 253917 | 4/1948 | Switzerland | 312/257 SK |
| 433633 | 9/1967 | Switzerland | 312/111 |
| 1167982 | 10/1969 | United Kingdom | 312/111 |

*Primary Examiner*—Victor N. Sakran

*Attorney, Agent, or Firm*—McWilliams, Mann, Zummer and Sweeney

[57] ABSTRACT

An assembly for modular-type furniture is disclosed, including a vertical support post of rectangular cross-section, a panel and a horizontal structural member. At least one corner of the post has a pair of narrowly spaced-apart vertically extending flanges defining a slot for the end edge of the panel such that the panel and one contiguous surface of the post are in a nearly common plane. The panel is thinner than the width of the post and thinner than the structural member.

5 Claims, 5 Drawing Figures

CABINET ASSEMBLY SYSTEM

FIELD OF THE INVENTION

The present invention relates to modular furniture in general, more particularly to an innovative vertical structural member and panel for such furniture.

BACKGROUND OF THE INVENTION

Since modular furniture has been steadily gaining ground in popularity attempts have been made to construct components which are sturdy, durable and visually appealing yet lightweight and easy to assemble. The disadvantage of previous modular furniture assemblies inheres in the fact that not all of the above characteristics have been met.

OBJECTS OF THE INVENTION

It is an important object of the present invention to provide modular furniture comprising a vertical support post having a rectangular, cross-section and provided at at least one of its corners with a panel retaining means, in combination with a thin panel held in place between the panel retaining means.

It is another object of the present invention to provide a post and panel of the above type in combination with relatively thicker horizontal shelf and structural members.

It is still another object of the invention to provide a post and panel of the above type which possesses all of the above-mentioned characteristics as well as being non-costly to produce.

SUMMARY OF THE INVENTION

The above objects and others are realized according to a preferred embodiment comprising at least one vertical support post in combination with at least one relatively thinner panel and at least one horizontal structural member which is much thicker than the panel for added sturdiness.

The post is provided along its entire length with a panel retaining means adapted to retain a thin panel to thus form a front, rear or lateral wall as well as interior partitions in the modular structure which is desired. This panel retaining means is integrally formed with the post at the time of its manufacture.

At least one corner of the post is provided with the panel retaining means and the latter is located such that the panel, once installed, extends in substantially the same plane as one face of the contiguous structural post.

The above will become clear by having referred to the preferred embodiment of the invention, illustrated by way of the accompanying drawings in which:

BRIEF DESCRIPTION OF THE DRAWINGS

Like numerals refer to like elements throughout the drawings.

DETAILED DESCRIPTION OF THE INVENTION

The cabinet assembly system of the present invention comprises a vertical support post 1 made of rigid material, preferably extruded plastic. Post 1 is of rectangular cross-section, preferably square, and is also preferably hollow for economic reasons.

Post 1 is provided with a panel retaining means at one corner 2 consisting of a pair of narrowly spaced-apart and vertically extending flanges 3 and 4, thus forming a slot for the end-edge of a thin panel 5.

Figure 2:
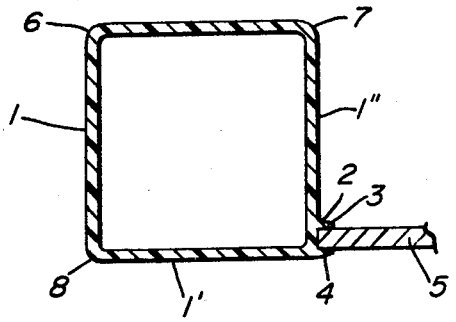
FIG. 2 is a plan section of the post and part of a panel secured in place.

As clearly shown in FIG. 2 flanges 3 and 4 are integrally formed in post 1, extending parallel to the front face 1'' at corner 2. Thus panel 5 and front face 1 extend in a substantially common plane, providing an aesthetic finish on the outside of the cabinet.

Figure 1:
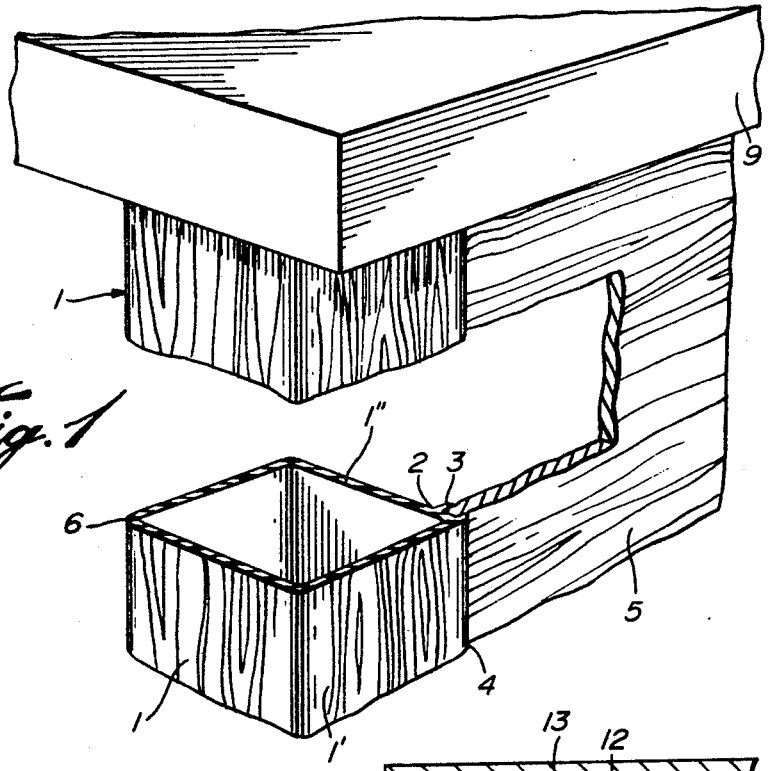
FIG. 1 is a perspective view, partially cut away, of a portion of the post, a thin panel and a horizontal structural member forming a corner.
Figure 3:
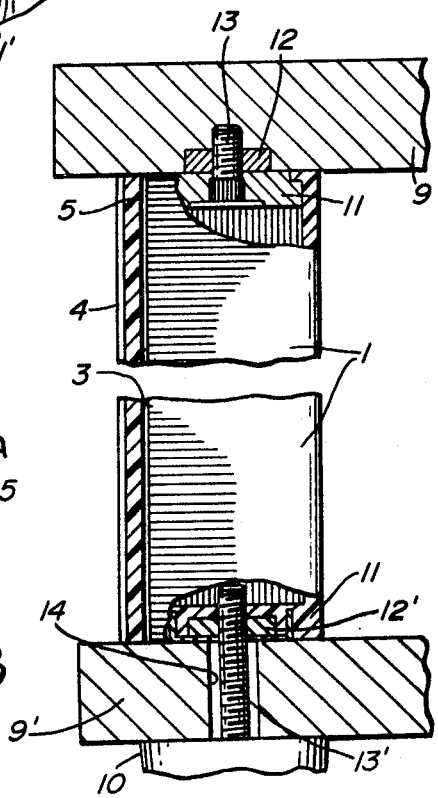
FIG. 3 is a vertical section showing upper and lower structural members and the contiguous post and panel portions.
Figure 5:
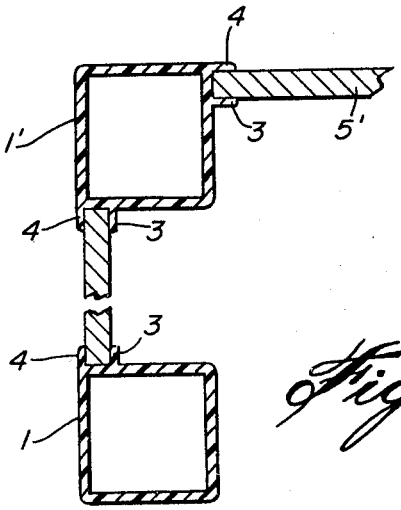
FIG. 5 is a plan section of the same.

FIGS. 1, 2 and 3 illustrate only one corner post 1 provided with flanges 3 and 4 but it will readily obvious that the diagonally opposite corner 6 can also be provided with the flanges as shown in FIG. 5 by post 1' if post 1' is located at the rear corner of a furniture structure and that it is desired to provide a back thin panel 5'. Alternatively one of the other two corners 7 or 8 could also be thus equipped if partitions are desired.

Panel 5 or 5' is removable from between flanges 3 and 4 since it has a sliding fit therewith. Panel 5 may be made of pressed wood or any other suitable rigid material.

Panel 5 is much thinner than the width of post 1.

The invention also comprises, in combination with post 1 and panel 5, at least one horizontal structural member 9. It is made of any suitably rigid material and has a thickness intermediate the width of post 1 and the thickness of panel 5.

Attachment means are provided to fasten post 1 and members 9. In FIG. 3 two members 9 and 9' are shown, the lower one being provided with a leg 10 or other floor-engaging means.

The underside of member 9 carries a nut 12.

Hollow post 1 or 1' is fitted with end plugs 11 secured to the post. One plug has a bore in which is fitted a nut 12' while the other plug securely carries a bolt 13 protruding from the post.

In FIG. 3 the bolt 13 of post 1 or 1' is first screwed into the nut 12 of top member 9 by rotating the post then the bolt 13' of leg 10 is freely inserted into bore 14 of lower panel 9' and screwed into nut 12' of the post by rotating leg 10.

Figure 4:
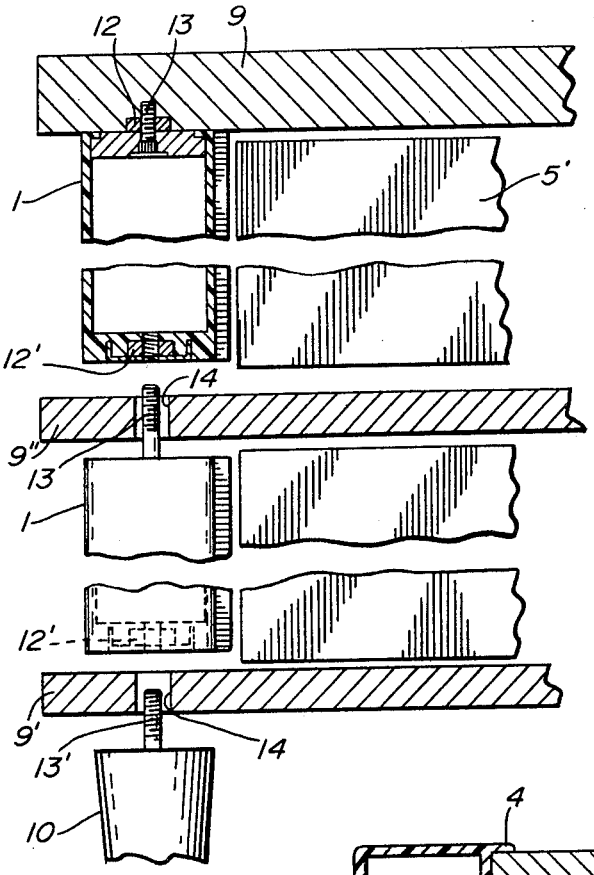
FIG. 4 is an exploded front elevation of an article of furniture in accordance with the invention.

FIG. 4 shows that several posts and intermediate shelves 9'' can be assembled using the same procedure.

As shown in FIG. 1 post 1 may have a simulated wood finish to match with panel 5.

What we claim is:

1. A cabinet assembly system comprising, in combination, at least one vertical support post having a rectangular cross-section, being provided at least on one corner with a pair of narrowly spaced-apart, integrally formed and vertically extending flanges defining a slot; at least one panel having an end edge adapted to be retained between said flanges; at least one horizontal structural member adapted to be secured to said post, said member including fastening means disposed toward at least one corner thereof; attachment means disposed within the upper end of said vertical support post adapted to matingly engage said fastening means of said horizontal member to secure said structural member to said post; said panel and one contiguous surface of said post lying in a substantially common plane; said panel being thinner than the width of said post and said structural member having a thickness intermediate the thickness of said panel and the width of said post.

2. A cabinet assembly system as defined in claim 1 wherein said post is hollow and has a square cross-section.

3. A cabinet assembly system as defined in claim 1 wherein said pair of flanges is integrally formed with said post at one corner thereof.

4. A cabinet assembly system as defined in claim 3 wherein the corner diagonally opposite said corner is provided with a second pair of flanges.

5. A cabinet assembly system as defined in claim 1, 3 or 4 wherein there is a plurality of said posts, said panels and said horizontal structural members.

* * * * *